US007578691B2

(12) United States Patent
Weksler et al.

(10) Patent No.: US 7,578,691 B2
(45) Date of Patent: Aug. 25, 2009

(54) USB CONNECTOR LOCKING ARRANGEMENTS

(75) Inventors: Arnold S. Weksler, Raleigh, NC (US); Scott Edwards Kelso, Durham, NC (US); John Carl Mese, Cary, NC (US); Nathan J. Peterson, Raleigh, NC (US); Rod D. Walterman, Rougemont, NC (US)

(73) Assignee: Lenovo (Singapore) Pte. Ltd., Singapore (SG)

( * ) Notice: Subject to any disclaimer, the term of this patent is extended or adjusted under 35 U.S.C. 154(b) by 0 days.

(21) Appl. No.: 11/414,162

(22) Filed: Apr. 29, 2006

(65) Prior Publication Data

US 2007/0254514 A1 Nov. 1, 2007

(51) Int. Cl.
*H01R 13/625* (2006.01)

(52) U.S. Cl. ..... 439/347; 439/304; 439/911

(58) Field of Classification Search ..... 439/296, 439/346, 347, 304, 911
See application file for complete search history.

(56) References Cited

U.S. PATENT DOCUMENTS

| | | | | |
|---|---|---|---|---|
| 4,136,919 | A * | 1/1979 | Howard et al. | 439/346 |
| 6,745,330 | B1 | 6/2004 | Maillot | |
| 6,854,984 | B1 | 2/2005 | Lee | |
| 6,902,432 | B2 | 6/2005 | Morikawa | |
| 6,943,527 | B2 * | 9/2005 | Liu et al. | 320/107 |
| 6,960,092 | B1 * | 11/2005 | Hussain et al. | 439/263 |
| 7,160,137 | B1 * | 1/2007 | Yeh | 439/358 |
| 7,258,656 | B2 | 8/2007 | Lerner | |
| 2002/0147698 | A1 | 10/2002 | Tree | |
| 2003/0153214 | A1 | 8/2003 | Siddiqui | |
| 2004/0074264 | A1 | 4/2004 | Kung | |
| 2005/0039502 | A1 | 2/2005 | Avganim | |
| 2005/0174238 | A1 * | 8/2005 | Foseide | 340/568.4 |
| 2005/0202698 | A1 | 9/2005 | Miao | |

FOREIGN PATENT DOCUMENTS

| | | |
|---|---|---|
| JP | 2003-243093 | 8/2003 |
| JP | 2004-087462 | 3/2004 |

* cited by examiner

*Primary Examiner*—Neil Abrams
*Assistant Examiner*—Phuong Nguyen
(74) *Attorney, Agent, or Firm*—Ference & Associates LLC

(57) ABSTRACT

A USB connection arrangement, where more secure locking is afforded than has hitherto been achieved. With a first USB connecting portion and a second USB connecting portion, a locking arrangement is provided for physically securing the first USB connecting portion and the second USB connecting portion with respect to one another. The locking arrangement includes at least one receptor portion disposed on at least one of the first and second USB connecting portions, and at least one pin portion engageable with the at least one receptor portion for physically securing at least one of the first and second connecting portions with respect to the other of the first and second connecting portions.

3 Claims, 4 Drawing Sheets

USB CONNECTOR LOCKING ARRANGEMENTS

FIELD OF THE INVENTION

The present invention relates to Universal Serial Bus (USB) connectors for computers and other devices and to arrangements for locking or securing the USB connectors.

BACKGROUND OF THE INVENTION

USB connectors are widely known for facilitating connectivity of a given device with a computer or other device, to permit data or other information to be transmitted between the interconnected devices in question. At one end of a cable, an "A" connector typically connects "upstream" to a computer (e.g., desktop or laptop) while at another end a "B" or "mini B" connector typically connects "downstream" to a device such as a printer or digital camera. Alternatively, a device (e.g., a computer mouse) might not involve any USB connection at the "device end". On a computer itself, a USB receptacle will typically be configured to receive and accommodate a USB "A" connector while a device may include a USB receptacle configured for receiving and accommodating a "B" or "mini B" connector.

USB connections typically involve detents that are sufficient for holding "male" and "female" portions of the connection in place with respect to one another. However, this is rarely sufficient for preventing unauthorized disconnection of the connecting elements. Sometimes, inadvertent disconnections can even take place (e.g., if a device falls off a table and pulls a USB connection apart as a result). Accordingly, a perennial problem encountered with existing USB connectors is that in being so easy to disconnect, they are prone to a significant loss of data or other valuable information (as resident in one or more of the devices associated with the USB connector) by unauthorized individuals or simply by way of unforeseen physical accidents. Accordingly, a growing need has been recognized in connection with physically strengthening and providing greater security for USB connections.

SUMMARY OF THE INVENTION

There are broadly contemplated herein, in accordance with at least one presently preferred embodiment of the present invention, locking arrangements which are configured for securing one or more USB connectors in place such that an unauthorized or inadvertent disconnection or decoupling of a USB connector becomes difficult or virtually impossible. Also broadly contemplated herein are arrangements for unlocking such locking arrangements via a secured actuation device. While locking arrangements are broadly contemplated herein in connection with single USB connectors, there are also broadly contemplated herein locking arrangements for use in "stacked" USB connectors (i.e., where one or more USB connectors are disposed adjacent one another, such as in the case of many desktop computers), whereby a single actuation device can facilitate the locking of two or more USB connectors.

In summary, one aspect of the invention provides a computer connection arrangement comprising: a first connecting portion; and a second connecting portion; a locking arrangement for physically securing the first connecting portion and the second connecting portion with respect to one another; the locking arrangement comprising: at least one receptor portion disposed on at least one of the first and second connecting portions; and at least one pin portion engageable with the at least one receptor portion for physically securing at least one of the first and second connecting portions with respect to the other of the first and second connecting portions.

Furthermore, an additional aspect of the invention provides a USB connection arrangement comprising: a first USB connecting portion; and a second USB connecting portion; a locking arrangement for physically securing the first USB connecting portion and the second USB connecting portion with respect to one another; the locking arrangement comprising: at least one receptor portion disposed on at least one of the first and second USB connecting portions; and at least one pin portion engageable with the at least one receptor portion for physically securing at least one of the first and second connecting portions with respect to the other of the first and second connecting portions.

BRIEF DESCRIPTION OF THE DRAWINGS

The above and other objects, features, and advantages of the present invention will become more apparent from the following detailed description when taken in conjunction with the accompanying drawings, in which.

DETAILED DESCRIPTION OF THE INVENTION

As noted above, the present invention is directed to certain features of USB connectors. General information on the USB standard is available at http colon slash slash www dot usb dot org slash developers slash docs and elsewhere on this website.

Figure 1:
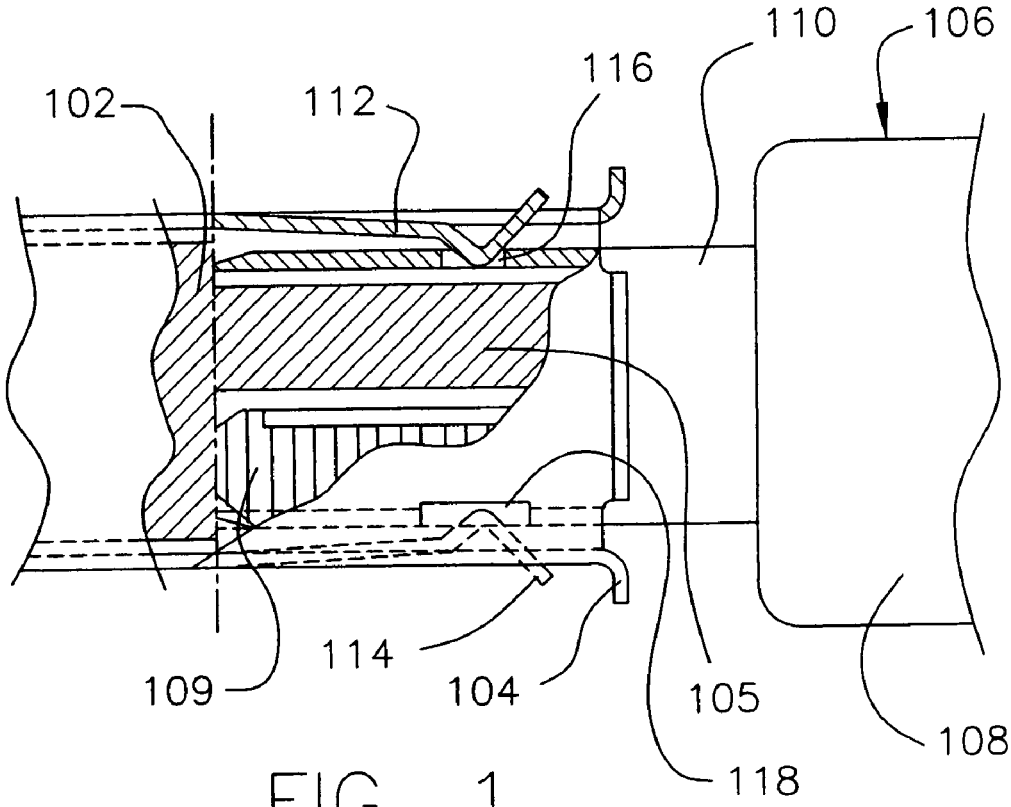
FIG. 1 is a partial cut-away view of a conventional USB connector.
Figure 2:
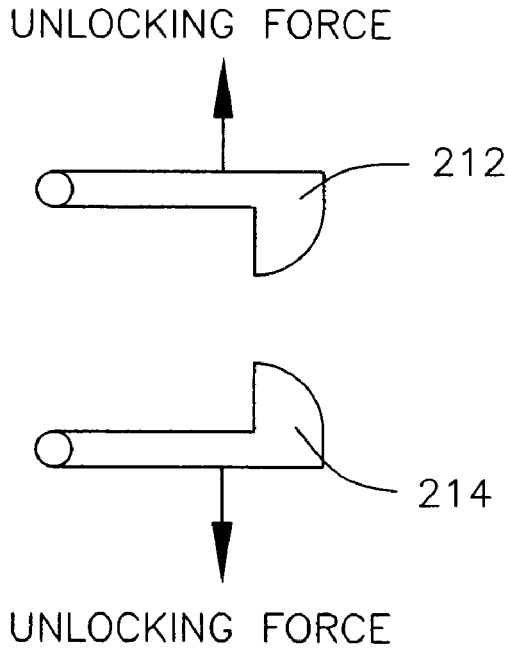
FIG. 2 illustrates conventional spring detents in isolation.

As shown in FIG. 1, a conventional USB "A" connector 102, in the form of a receptacle (e.g., in a personal computer), may be disposed in a housing 104. "A" connector/receptacle 102 includes, as known, a major protrusion or prong 105. "B" connector 106, which may extend from a cable (not shown) as previously discussed, includes a protrusion or prong 109 configured for interfacing with "A" connector/receptacle 102 and may be encased in, e.g., an overmold "boot" 108. Protrusion/prong 109, for its part, is normally surrounded by another housing or encasement 110. As is presently known, spring detents 112, 114 can extend from "A" housing 104 to engage with holes 116/118 in "B" housing 110. Normally, the force provided by detents 112, 114 is sufficient to hold the "A" and "B" connectors more or less firmly in place with respect to one another. As shown in FIG. 2, a sufficient unlocking force is normally needed to pull detents 212/214 apart from one another and thus enable a disconnection of USB "A" and "B" connectors with respect to one another. The force so required is normally not great, such that disconnection is usually quite easy to achieve and can be done by unauthorized individuals or by way of an "accident" (e.g., a device falling off a table and pulling a connector portion therewith).

Figure 3A:
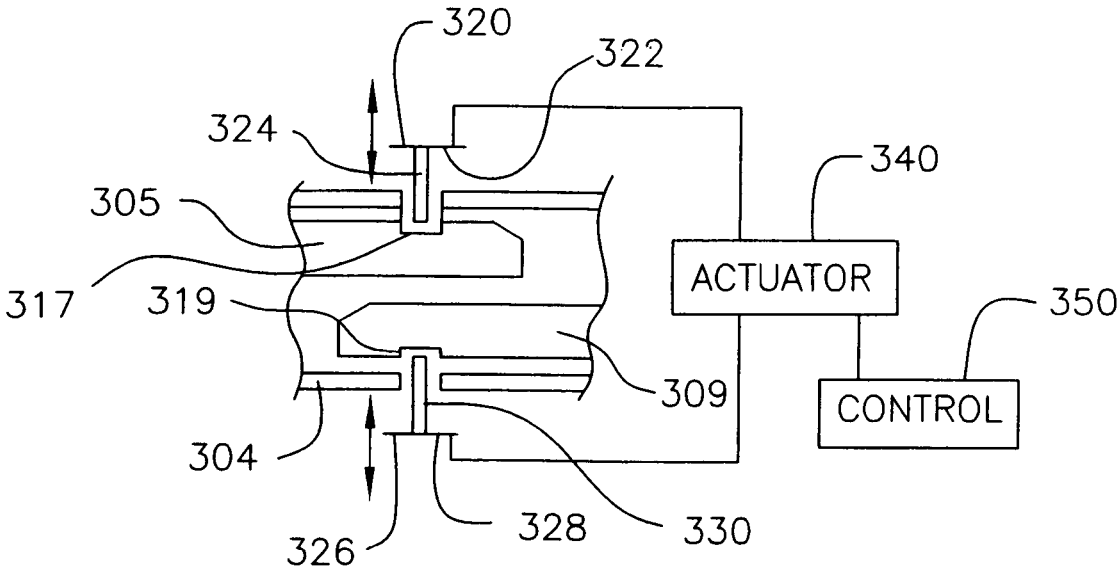
FIG. 3A illustrates a pin-locking mechanism in a USB connector.
Figure 3B:
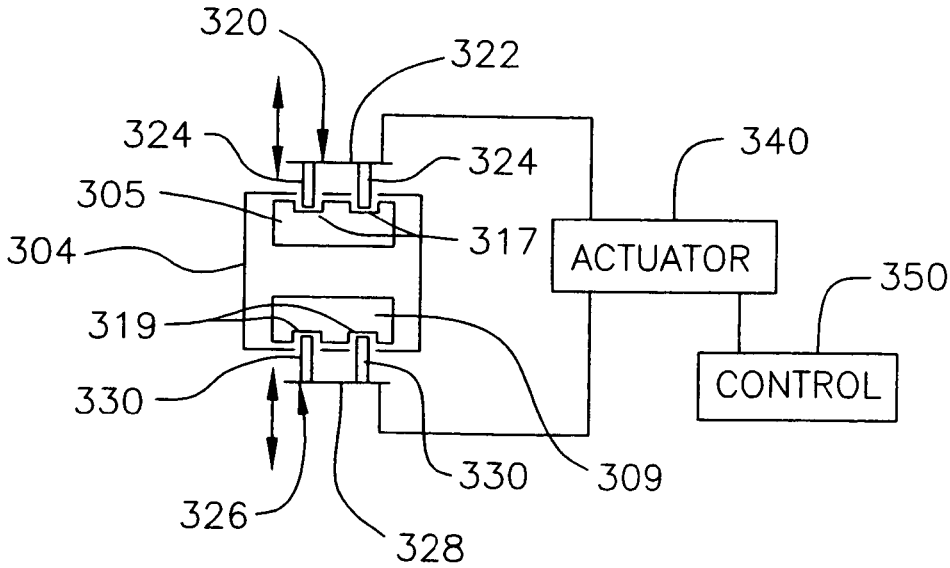
FIG. 3B is an orthogonally distinct view of the mechanism shown in FIG. 3A
Figure 3C:
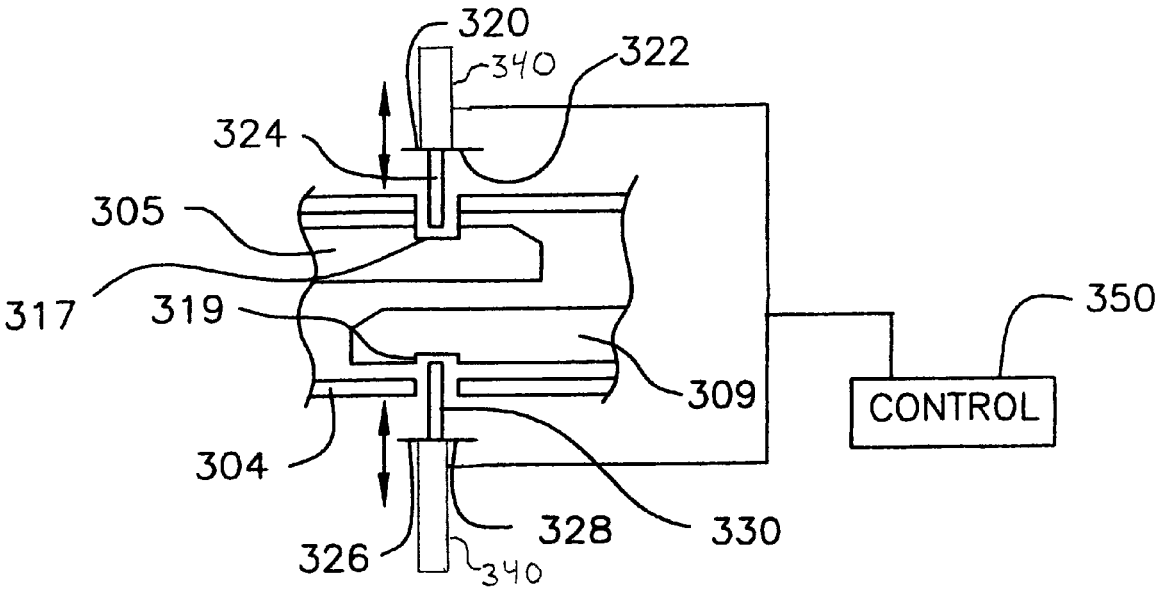
FIG. 3C illustrates a pin-locking mechanism in a USB connector with an alternative actuator.

In accordance with at least one presently preferred embodiment of the present invention, there are broadly contemplated herein locking arrangements for USB connectors which are much stronger and much more secure than in conventional connectors as just discussed. As shown in FIGS. 3A, 3B, and 3C, an outer housing 304 may accommodate "A" connector prong 305 and "B" connector prong 309. Prongs 305/309 preferably include two wells or recesses each (317, 319, respectively). A first pin mechanism 320 may include a back plate or other mount 322 from which extend a pair of pins 324. Similarly, a second pin mechanism 326 may include a back plate or other mount 328 from which extend a pair of pins 330. Pins 324 are preferably engageable with wells 317, and pins 330 with wells 319, in such a manner as to firmly lock the respective prongs 305, 309 in place. Preferably, the force holding prongs 305/309 in place with respect to one another is much greater than that in the case of conventional spring detents (see e.g. FIG. 1 and accompanying description).

Preferably, a suitable actuator 340 (with control 350 therefor) is provided which can engage and disengage the pints 324/330 from wells 317/319 in a manner to lock and unlock the prongs 305/309 with respect to one another. Accordingly, an "unlocked" state can be manifested selectably by an authorized individual. A very wide variety of locking/unlocking protocols are thus conceivable. For instance, locking could be automatic when a computer is shut down while (under the assumption that the computer is protected by passwords or another security feature to begin with) unlocking could be automatic when a computer is booted up. Accordingly, essentially any suitable mechanical actuation device (e.g., an electromagnetic switch, solenoid, memory wire, bimetallic strip, etc.) is conceivable for use as an actuator 340. Alternatively, a more strictly mechanical arrangement is conceivable such as a simply key mechanism (e.g., whereby the turn of a key would engage or disengage the pins 324/330 from wells 317/319; for instance, a key lock could be mounted on the outside of the computer or other device and could be configured to rotate a cam assembly that would disengage or engage the pins). In FIGS. 3A and 3B, actuator 340 is represented by a block; in FIG. 3C actuator 340 as depicted is a mechanical actuation device such as a soleniod which controls the positioning of pins 324 and 330.

Figure 4A:
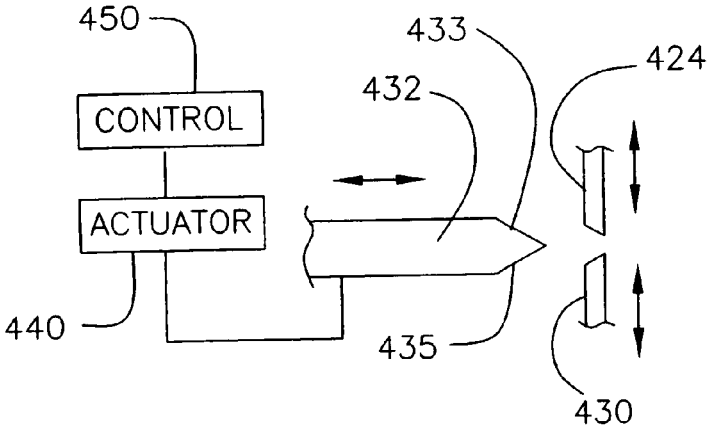
FIG. 4A illustrates another pin-locking mechanism, in a first position.
Figure 4B:
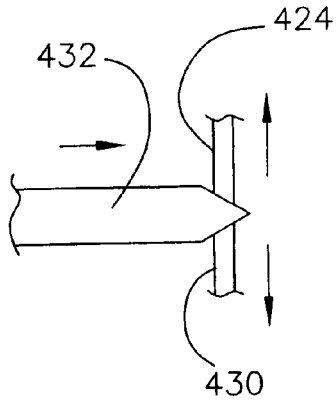
FIG. 4B illustrates the pin-locking mechanism of FIG. 4A, in a second position.

Often, especially in the case of desktop computers, USB ports can be "stacked" atop one another (e.g., disposed adjacent one another). FIGS. 4A/B illustrate an alternative arrangement for such a setting. As shown, a sliding element 432 may include sloped end surfaces 433/435. Reciprocating pins 424, 430 are preferably disposed and configured to separately engage with different USB ports. (Though not shown, it should be understood that there may preferably be two pins disposed one behind the other at reference numerals 424 and 430, whereby each pair can respectively engage with two "wells" in a USB connector prong substantially as illustrated and described with respect to FIGS. 3A/B/C.) Pins 424/430 preferably present sloped end surfaces of their own accord, which match and are engageable with the surfaces 433/435 of sliding element 432. As shown, in an "unlocked" position as in FIG. 4A, sliding element 432 is not engaged with pins 424/430, while pins 424/430 are essentially "retracted" from their respective USB connectors. To "lock" the pins 424/430 into their USB connectors, on the other hand, sliding element 432 preferably slides (to the right in the drawings) and pushes pins 424/430 apart from one another so that they engage with wells or holes in the respective USB connectors as previously described. Again, since pins 424/430 in this case are respectively associated with different USB connectors, sliding element 432 of its own accord may lock and unlock at least portions of different USB connectors all at once. Actuator 440 and control 450 can largely be configured to operate automatically or manually, in response to an operator prompt or otherwise, substantially as described above in connection with FIGS. 3A/B/C in this case, however, actuator 440 is specifically configured to drive the sliding motion of sliding element 432.

Figure 5:
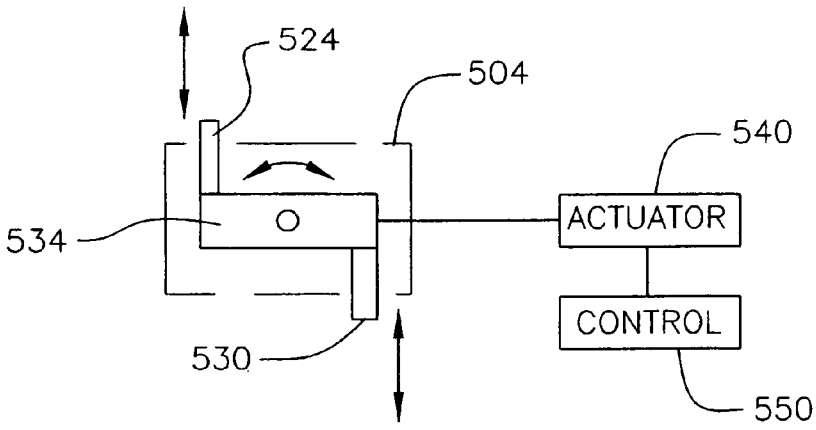
FIG. 5 illustrates yet another pin-locking mechanism.

FIG. 5 illustrates an alternative embodiment for "stacked" or adjacent USB connectors. In this case, within a housing 504 there may preferably be disposed a rotating or pivoting element 534 from which extend a first pin 524 and a second pin 530, respectively engageable with different USB connectors (similarly to the context of FIGS. 4A/B). Pins 524/530 are thus preferably configured to extend from and retract into housing 504 in response to rotational/pivoting motion of element 534. Accordingly, with respect to FIG. 5, upon clockwise pivoting of element 534, pins 524/530 will both extend from housing 504 to engage with wells or holes in USB connector prongs substantially as discussed heretofore. In the same vein, upon counterclockwise pivoting of element 534, pins 524/530 will retract away from their respective USB connectors. Actuator 540 and control 550 can again be configured in essentially any suitable or desired manner, with the proviso that actuator 540 drives rotary/pivoting motion of element 534. A primary different here with respect to FIG. 4A/B is that fewer pins can be provided, i.e., instead of one pair of pins for engaging with a given USB connector there might only be a single pin. However, the pins 524/530 can preferably be configured and disposed such that their engagement with wells/holes in USB connector prongs is still sufficient to achieve substantially the same functional results as discussed heretofore in connection with other embodiments.

If not otherwise stated herein , it is to be assumed that all patents, patent applications, patent publications and other publications (including web-based publications) mentioned and cited herein are hereby fully incorporated by reference herein as if set forth in their entirety herein.

Although illustrative embodiments of the present invention have been described herein with reference to the accompanying drawings, it is to be understood that the invention is not limited to those precise embodiments, and that various other changes and modifications may be affected therein by one skilled in the art without departing from the scope or spirit of the invention.

The invention claimed is:

1. An apparatus comprising:

a computer data connection arrangement comprising:

a USB port having a housing therein; and a locking arrangement disposed within the housing that physically secures at least one connector prong having a well to the housing;

said locking arrangement comprising:

at least one pin portion engageable with the well of the at least one connector prong for physically securing the at least one connector prong to the housing;

wherein engagement and disengagement of the at least one pin portion is controlled in response to an electrical signal generated within the apparatus;

wherein the locking arrangement secures automatically when the apparatus is shut down; and further wherein the apparatus is protected by a password.

2. The apparatus according to claim 1, wherein the at least one connector prong comprises at least one USB connector portion.

3. An apparatus comprising:

a USB connection arrangement comprising:

a plurality of USB ports having a stacked housing therein; and a locking arrangement for physically securing a plurality of USB connector prongs with the housing;

said locking arrangement comprising:

at least one pin portion engageable with a plurality of wells disposed on said plurality of USB connector prongs for physically securing said plurality of USB connector prongs with respect to the housing;

wherein engagement and disengagement of the at least one pin portion is controlled in response to an electric signal generated within the apparatus;

wherein the locking arrangement secures automatically when the apparatus is shut down; and further wherein the apparatus is protected by a password.

* * * * *